United States Patent [19]

Bornemann et al.

[11] Patent Number: 5,016,576

[45] Date of Patent: May 21, 1991

[54] FLUIDIZING COMBUSTION CHAMBER

[75] Inventors: Gert Bornemann, Erlensee; Hans-Jürgen Heibel, Frankfurt am Main, both of Fed. Rep. of Germany

[73] Assignee: Metallgesellschaft Aktiengesellschaft, Frankfurt am Main, Fed. Rep. of Germany

[21] Appl. No.: 480,413

[22] Filed: Feb. 15, 1990

[30] Foreign Application Priority Data

Feb. 23, 1989 [DE] Fed. Rep. of Germany ..... 3905553

[51] Int. Cl.[5] ..... F22B 1/00

[52] U.S. Cl. ..... 122/4 D; 110/245

[58] Field of Search ..... 122/4 D; 110/245; 432/58, 15

[56] References Cited

U.S. PATENT DOCUMENTS

| | | | |
|---|---|---|---|
| 3,514,968 | 6/1970 | Kusuda et al. | 62/227 |
| 4,377,119 | 3/1983 | Noack | 122/4 D |
| 4,398,477 | 8/1983 | Iwasaki | 110/245 |
| 4,444,017 | 4/1984 | Briccetti et al. | 62/84 |
| 4,514,989 | 5/1985 | Mount | 62/201 |
| 4,597,362 | 7/1986 | Dandet et al. | 110/245 |
| 4,651,653 | 3/1987 | Anderson et al. | 122/4 D |
| 4,682,948 | 7/1987 | Cohen | 122/4 D |

*Primary Examiner*—Henry C. Yuen

*Attorney, Agent, or Firm*—Sprung Horn Kramer & Woods

[57] ABSTRACT

The combustion chamber for combusting finegrained fuels in a fluidized bed at temperatures from 700° to 1100° C. is provided with a refractory lining in the lower portion of the chamber on the inside surface of the watercooled wall. The lining is provided at its top end with a cornice, which is enlarged in width. The width of the cornice is preferably at least 1.5 times the wall thickness of the brick lining below the cornice.

2 Claims, 1 Drawing Sheet

FLUIDIZING COMBUSTION CHAMBER

Figure 1:
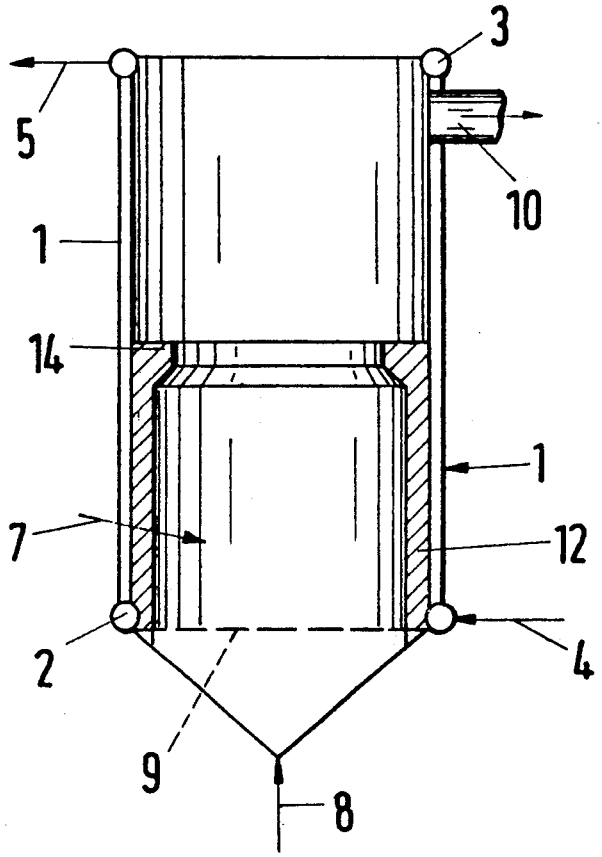

This invention relates to a combustion chamber for combusting fine-grained fuels in a fluidized bed at temperatures from 700° to 1100° C., comprising a refractory lining provided in the lower portion of the chamber on the inside surface of the water-cooled wall of the combustion chamber.

A combustion chamber of that kind has been described in Published German Application No. 36 23 177. It that case the lining provided on the inside surface of the combustion chamber consists of a brick lining, which covers the lowermost one-third of the inside surface of the combustion chamber. The gases rising in the combustion chamber are partly cooled by the water cooling of the combustion chamber wall and the velocity of the gas molecules is thus reduced in that region. As a result, there is a downward flow of the gases close to the inside surface of the combustion chamber wall, particularly above the lining. That downward flow has an abrasive action so that a considerable wear of the steel wall of the combustion chamber will result particularly closely above the top end of the lining because strong turbulence is produced there.

It is an object of the invention to provide in a simple manner a protection of the inside surface of the combustion chamber in the region which is particularly endangered by wear. This is accomplished in accordance with the invention in that the lining is provided at its top end with a cornice which is enlarged in width. During the combustion operation, a stationary bed of solids will form on that cornice and will effectively protect the most highly endangered region of the combustion chamber wall.

The cornice which is enlarged in which and terminates the lining at its top must have a width that exceeds the wall thickness of the lining and suitably has a width which is at least 1.5 times the wall thickness of the lining closely below the cornice. In practice the width of the cornice is in the range from 10 to 60 cm, preferably from 15 to 50 cm.

The refractory lining consists in known manner of a protective layer, e.g., of concrete, or of a brick lining. The height of the lining suitably amounts to 0.2 to 0.6 time the height of the combustion chamber. The upper portion of the combustion chamber is not provided with a lining so that an effective heat transfer resulting in an improved steam production can be obtained there.

The provision of the lining with a cornice which is enlarged in width will be particularly recommendable for combustion chambers which are included in a combustion system that is operated in accordance with the principle of the circulating fluidized bed. Details of the circulating fluidized bed have been described in German Patent Specification No. 25 39 546. In that case, relatively high gas velocities of about 4 to 7 m/s will occur in the lower portion of the combustion chamber and similarly high velocities in a downward direction will occur on the inside surface of the combustion chamber so that a considerable abrasive wear will result on the wall of the combustion chamber. Combustion chambers of that kind consist in most cases in known manner of tube walls consisting of closely adjoining vertical tubes, in which water is conducted.

Figure 2:
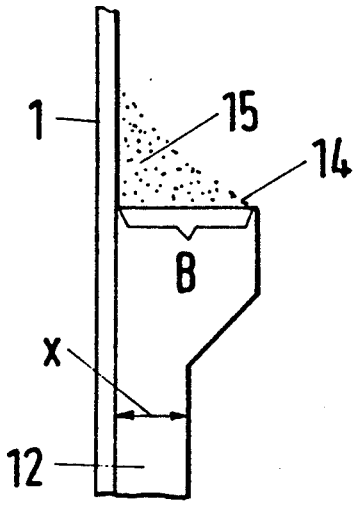
Figure 3:
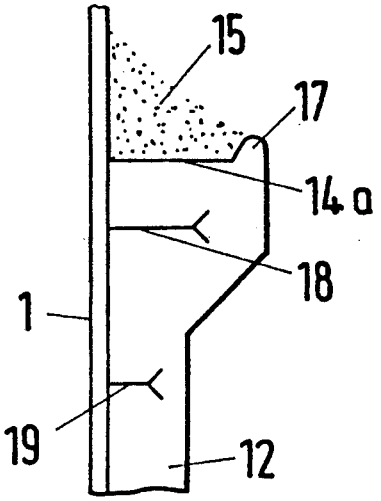

Details of the invention will be explained with reference to the drawing, in which FIG. 1 is a diagrammatic longitudinal sectional view showing the combustion chamber, FIG. 2 is an enlarged longitudinal sectional view showing the upper portion of the lining and FIG. 3 is a longitudinal secitonal view showing a modification of the cornice.

The combustion chamber shown in FIG. 1 comprises a cylindrical tube wall 1, which communicates with a lower annular distributing manifold 2 and with an upper annular collecting manifold 3. Cooling water is supplied in line 4 and evaporates in part in the vertical tubes of the wall 1. A mixture of water vapor and water is collected in the top annular manifold 3 and is withdrawn in line 5. The cross-section of the combustion chamber need not be round but may be square or rectangular.

Fine-grained fuels, such as coal, are supplied to the combustion chamber in the line 7. Said fuels are burnt with the aid of air from line 8. The air is first pressed through a distributing grate 9. Additional air supply nozzles directed into the combustion chamber have not been shown for the sake of simplicity. The grate 9 is not essential. The conditions of a fluidized bed or of a circulating fluidized bed are maintained in the combustion chamber, in which the fine-grained fuels are burnt at temperatures in the range from 700° to 1100° C. Solids-containing combustion gases leave the combustion chamber through the duct 10.

The lower region of the inside surface of the tube wall 1 is protected from wear and overheating by a refractory lining 12. The dissipation of heat through the tube wall 1 will result in a turbulent vertical flow of the gases close to the inside surface of the tube wall with considerable velocities occurring in the downward direction. In order to protect the material, usually steel, on the inside surface of the tube wall from wear in the most highly endangered region closely above the lining 12, the lining is provided at its top end with a cornice 14, which is enlarged in width and is shown on a larger scale in FIG. 2.

During the operation of the combustion chamber a stationary bed 15 of solids is formed on the cornice, see FIG. 2. The cornice 14 has a sufficiently large width so that the bed 15 will be permanently maintained on the cornice 14 in spite of the turbulent gases. The width 8 of the cornice is at least 1.5 times and preferably 2 to 4 times the thickness of the lining 12. The bed 15 will prevent an exposure of the inside surface of the tube wall 1 closely above the lining 12 to the wear by agitated solids.

In the modification shown in FIG. 3 the cornice **14*a* is provided with an upwardly protruding ledge 17, which constitutes an additional backing for the solids bed 15 being formed. FIG. 3 shows also how the cornice and the lining are anchored to the tube wall by horizontal ties 18 and 19. Such ties have been omitted in FIGS. 1 and 2** for the sake of cleanness.

It will be appreciated that the instant specification and claims are set forth by way of illustration and not limitation, and that various modificiations and changes may be made without departing from the spirit and scope of the present invention.

What is claimed is:

1. An apparatus for combusting fine-grained fuels in a fluidized bed at high temperature, the apparatus including a combustion chamber having a wall, said wall containing tubes for flow therethrough of cooling water, a refractory lining on the inside surface of the lower portion of the wall, and a cornice comprising a ledge of enlarged width on the top of the lining and shaped to maintain a bed of solid particles, said wall being free of said refractory lining above said ledge, the width of the cornice being at least 1.5 times the thickness of the lining below the cornice.

2. An apparatus according to claim 1, for combustion in a circulating fluidized bed.

* * * * *